United States Patent [19]

Abel

[11] Patent Number: 4,493,501

[45] Date of Patent: Jan. 15, 1985

[54] SECURITY LOCK FOR SLIDING DOORS OR WINDOWS

[76] Inventor: Earl E. Abel, 7703 S. 128th St., Seattle, Wash. 98178

[21] Appl. No.: 485,315

[22] Filed: Apr. 15, 1983

[51] Int. Cl.[3] ..... E05C 17/34

[52] U.S. Cl. ..... 292/263; 292/DIG. 46

[58] Field of Search ..... 292/DIG. 46, 262, 263, 292/338, 339

[56] References Cited

U.S. PATENT DOCUMENTS

| | | | |
|---|---|---|---|
| 2,567,029 | 9/1951 | Sauter | 292/263 X |
| 3,698,754 | 10/1972 | Means | 292/DIG. 46 X |
| 3,825,290 | 7/1974 | Messina et al. | 292/263 X |
| 4,302,038 | 11/1981 | Ervine | 292/DIG. 46 |
| 4,318,559 | 3/1982 | Burton | 292/263 |

*Primary Examiner*—Richard E. Moore

*Attorney, Agent, or Firm*—Keith D. Gehr

[57] ABSTRACT

The disclosure relates to a secure locking mechanism for a sliding door or window. It comprises a toggling pair of bars, one of which is attached to the door frame and the other to the casing so that the bar lies across the fixed pane. The first bar is an inverted channel which encloses a portion of a second preferably solid bar. A pair of longitudinally side by side holes is drilled through both bars in the overlapping portion. The bars are joined in this area by one or more pins inserted through the holes. One hole is located adjacent to the distal end of the solid bar so that it can act as a pivot when the bars are united by a pin passing through this hole. The bars can then toggle to permit the door to be opened. If both holes are pinned or if a single pin is placed so that it passes through the other hole in the solid bar the assembly is securely locked.

9 Claims, 8 Drawing Figures

SECURITY LOCK FOR SLIDING DOORS OR WINDOWS

BACKGROUND OF THE INVENTION

The present invention relates to a locking mechanism for sliding doors or windows offering improved security and convenience over those which have been previously available.

Sliding doors and windows are finding wide current architectural usage because they are inexpensive to construct and do not require clearance in the interior of the building. Despite these advantages, they have been an easy point of entry for burglars and other types of criminals. To date, most of the locking mechanisms for sliding glass panels of this type have been primitive and unsatisfactory. Many of these locks can be overcome by simply forcing a pry bar between the door or window and it's casing and applying a moderate amount of force. In view of this well-known weakness, most homeowners adopt the expedient of laying a dowel in the lower track of the sliding panel. While this may discourage the unskilled thief, it is usually not effective against the professional burglar who can often insert a thin bar along the edge of the window and flip the dowel out of the channel. This is especially easy to do if the door has been slightly opened to obtain better ventilation.

Another common security device is a hinged bar across the door. This is attached at one end to the door or window frame while the other end rests in a channel attached to the casing. This bar needs only be lifted from the retaining channel in order to open the door. Once again, enterprising thieves have devised tools and means to accomplish this purpose in a fair number of installations.

Other means which offer a higher degree of security are known, but these are considered by most people to be undesirable from points of complexity, expense, or appearance. There has been a major unfilled need for a highly effective security device for sliding doors or windows that is simple, moderately priced, and does not detract from the esthetic appearance.

SUMMARY OF THE INVENTION

The present invention is a locking mechanism for a sliding door or window which comprises a pair of toggling bar members which can be readily mounted transversely across the fixed panel to secure the sliding panel of the door or window. For the purposes of the present invention, sliding doors and windows and similar types of panels will be considered as full equivalents. For the sake of simplicity, only doors will normally be mentioned in the following description and this term will be considered to be generic.

The mechanism comprises a pair of anchor means, one of which is adapted for mounting on the door frame of the sliding door, while the other is adapted for mounting on the opposing door casing. The toggling bar consists of a first member in the form of an inverted U-shaped channel having opposed sidewall portions. The proximal end of this first bar member is pivotally mounted to one of the anchor means. A second bar member which has a cross section adapted to fit between the sidewall portions of the first bar member is pivotally mounted at its proximal end to the other anchor means. These bar members have an overlapping zone in which the second bar member is embraced within the channel between the sidewall portions of the first bar member. The first bar member has one aperture drilled or otherwise formed through both sidewall portions adjacent to the distal end. A second or inner aperture, longitudinally displaced toward the proximal end of the bar from the distal aperture, is similarly placed through both sidewall members. The second bar member also has distal end and inner apertures formed in the area of the overlapping zone in locations that correspond to the apertures in the first bar member so that these apertures can overlie each other. When in overlying positions, the apertures are adapted to receive removable pin means. When pins are present through both sets of overlying apertures, the bars are in a locked configuration. When only a single pin is present through the inner aperture of the first member and the distal aperture of the second member, the bars are pivoted in a toggling relationship to permit the door to be opened.

In a preferred version of the invention, the second bar member is longitudinally slideable within the sidewall portions of the first bar member. In this way the inner apertures of each member can be aligned and a single pin can be inserted through the apertures to lock the bars. This permits the door to be safely locked open for a width corresponding to the longitudinal distance between the apertures.

The proximal end of the first or channel shaped bar member may contain an insert section immovably fastened between the sidewall portions. This insert section will, in turn, be the part of the first bar member which is pivotally mounted to the anchor means. By using different lengths of insert sections, the locking mechanism can be readily adapted for use on doors of various widths.

It is an object of the present invention to provide a locking mechanism for a sliding door or window which is inexpensive, simple in construction, and esthetic in appearance.

It is another object to provide a locking mechanism for a sliding door or window which is highly effective.

It is a further object to provide a locking mechanism which enables a door or window to be opened slightly for ventilation yet remain secure against entry.

These and many other objects will become readily apparent to those skilled in the art upon reading the following detailed description taken in conjunction with the drawings.

DETAILED DESCRIPTION OF THE PREFERRED EMBODIMENTS

Figure 1:
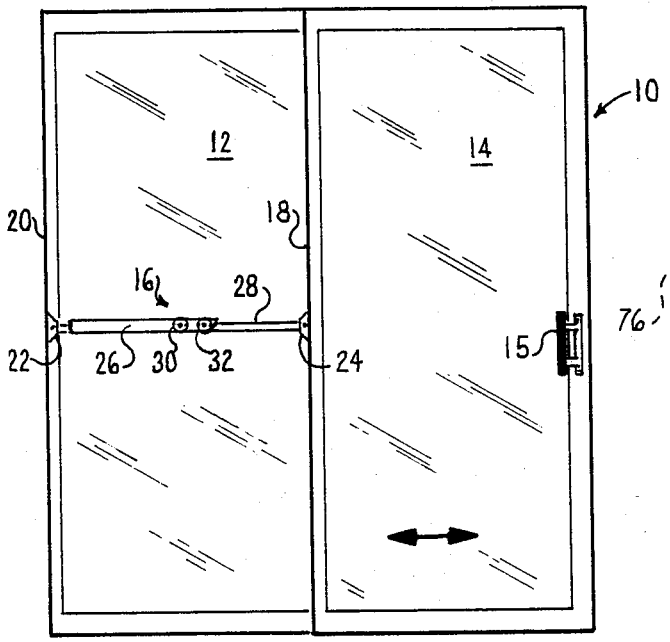
FIG. 1 is a side elevation showing the locking mechanism in place on a sliding door.

Reference is now made to the figures where the invention will be described in detail. In FIG. 1 the locking mechanism is seen installed on a sliding glass door or window 10. This consists of a fixed pane or panel 12 and a slideable panel 14. The locking mechanism 16 is installed between frame member 18, of sliding door 14, and the opposite casing member 20. A first anchor means 22 is attached to the casing, and a second and similar anchor means 24 is attached to frame 18. These anchor means can conveniently be yokes or saddles which are mounted to the respective frame and casing members by self-tapping screws or any similar well known fastening means. The locking mechanism further comprises a first channel shaped bar member 26, generally in the form of an inverted U having opposed sidewall portions. Insert or extension section 34 is held between the sidewall portions at the proximal ends of the first bar member by means of a pin or rivet 36. The opposite end of this insert section is pivotally mounted in the casing anchor means 22 by pin 23. The length of this insert portion can be readily changed so that the locking mechanism is easily adapted for doors or windows of different widths.

A second bar member 28, normally a solid bar of rectangular cross section, is pivotally mounted to the door frame anchor 24 by pin 25. The distal end of the second bar member 28 is loosely embraced within the channel at the distal end of the first bar member to form an overlapping zone which may conveniently be about 150 mm in length.

Figure 6:
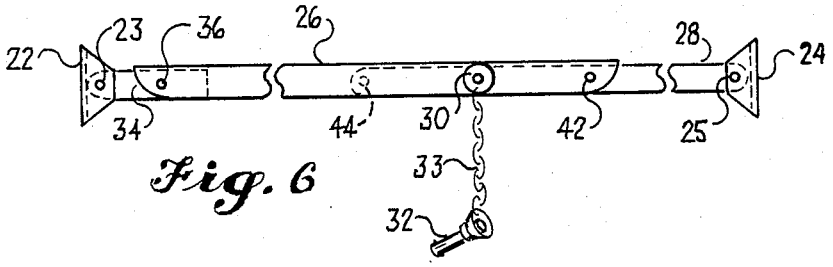
FIG. 6 is a side elevation showing the mechanism in locked configuration for use on a door which is partially open to permit ventilation.
Figure 7:
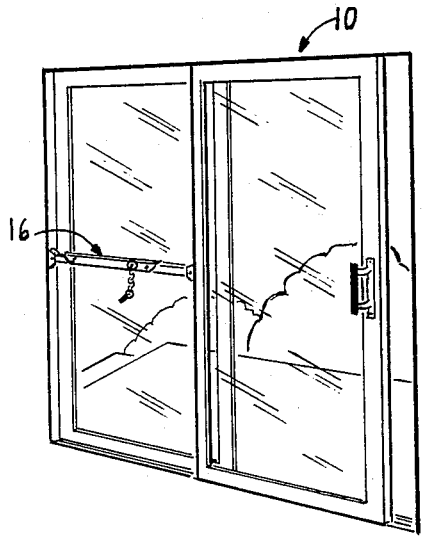
FIG. 7 is perspective view showing the mechanism on a locked door.
Figure 8:
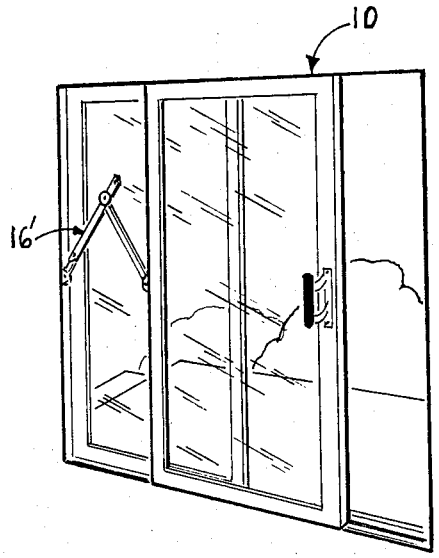
FIG. 8 is a view similar to that of FIG. 7 in which the door is partially open and unlocked.

The first bar member contains a hole or aperture 42, drilled or formed in the distal end, and a second aperture 40 located longitudinally inward approximately 100 mm away. These apertures are drilled through both the sidewall portions to receive ball-lock pins 30, 32. Corresponding apertures 44 and 46 are drilled respectively in the distal and inner sections of the second bar member. As a convenience to prevent loss, pins 30 and 32 may be united by a short length of chain 33 (FIG. 6). The distal end of second bar member 28 may be rounded into a half circle whose center is coincident with the center of the distal aperture.

Figure 2:
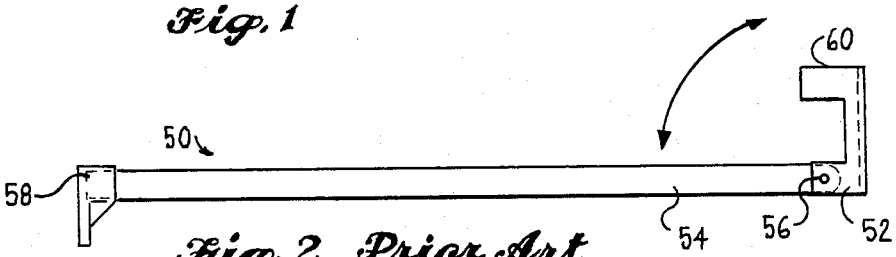
Fig. 2 Prior Art
FIG. 2 shows a prior art locking mechanism for a sliding door.

Before further describing the locking mechanism of the present invention, reference will be made to one of the most common prior art devices 50, shown in FIG. 2, and known in the art as a "Charley bar." This consists of a mounting bracket 52, which can be attached either to the frame or casing. A bar member 54 is pivotally attached to this bracket by pin 56. The opposite end of the bar rests in a saddle-shaped bracket 58 which, if bracket 52 were affixed to the door frame, would be affixed to the opposite casing. Bracket 52 will normally have a retainer clip 60 to hold the bar in an upright position when the door or window is unlocked. There is one problem with a security device of this type, other than the fact that it can usually be opened by an enterprising thief. It can be easily dislodged from clip 60, with the result that it can accidentally fall and mar the opposite frame or casing if the door is partially open. The device is also unsuited to secure a door partially opened for ventilation.

Figure 3:
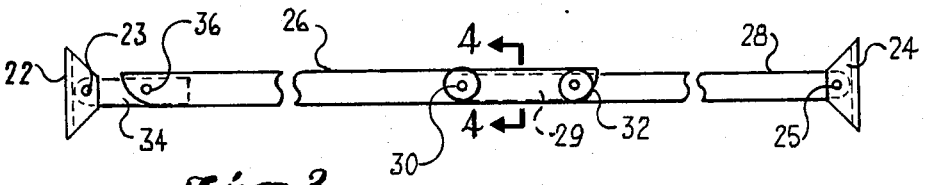
FIG. 3 is a side elevation showing details of the mechanism in locked position.
Figure 5:
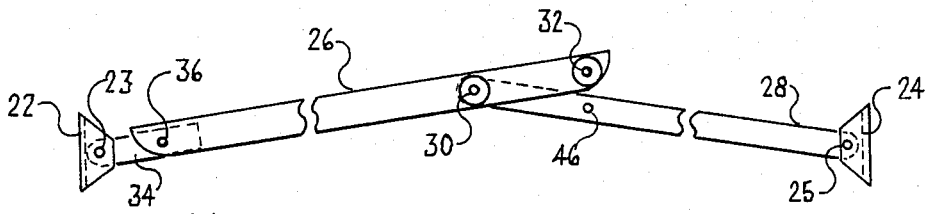
FIG. 5 is a side elevation showing the mechanism in unlocked configuration.

Operation of the present invention will now be described. When the holes or apertures in both bars are aligned, as shown in FIG. 3, and both of pins 30 and 32 have been inserted, the bars are locked together as a rigid member and the door cannot be opened. However, if pin 32 is withdrawn, pin 30 acts as a pivot and the bars can toggle upward permitting the door or window to be opened. If one wishes to ensure that the door can be easily opened, especially from the outside, pin 32 may be inserted through the distal hole in the channel shaped bar member as shown in FIG. 5. This pin will rest on the upper surface of the second bar member 28 so that the door remains almost fully closed. If it is desired to leave a door or window slightly open for ventilation yet secure against entry, this can be readily accomplished as is shown in FIG. 6. The door is slid open so that the inner aperture in bar member 28 is aligned with the inner aperture in the channel shaped member 26. A single pin inserted through the aperture rigidizes the assembly into a unitary bar.

Figure 4:
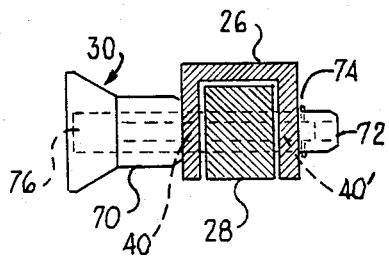
FIG. 4 is a vertical elevation in section taken along line 4—4 of FIG. 3.

The bars can be made of any convenient material in any convenient size. Extruded aluminum is a preferred material of construction. Typically, the channel member will be from 20 to 40 mm in height and about 15 to 20 mm in width. The solid bar member is sized accordingly. A preferred type of pin is a ball-lock quick release pin as shown in FIG. 4. These pins have a body 70 affixed to a pin portion 72. Ball members 74 prevent the pin from being withdrawn until plunger 76 is depressed. Pins of this type are available from Avibank Manufacturing, Inc., Burbank, Calif., and from other manufacturers.

Having thus described the best mode of construction and operation known to the inventor, it will be apparent to those skilled in the art that many changes could be made without departing from the spirit of the invention. The invention is thus considered to be limited only as it is defined in the following claims.

What is claimed is:

1. A locking mechanism for a sliding door or window which comprises:

a. a pair of anchor means, one of said anchor means adapted for mounting on a door frame and the other adapted for mounting on a door casing;

b. a first bar member in the form of an inverted generally U-shaped channel having opposed sidewall portions, said first bar being pivotally mounted at its proximal end to one of the anchor means;

c. a second bar member having a cross section adapted to fit between the sidewall portions of the first bar member, said second bar member being pivotally mounted at its proximal end to the other anchor means, said bar members having an overlapping zone where the second bar member is embraced with the channel between the side wall portions of the first bar member;

d. distal end and inner longitudinally displaced apertures formed through both sidewall portions of the first bar member in the area of the overlapping zone; and e. distal end and inner apertures formed through the second bar member in the area of the overlapping zone, said apertures having a longitudinal displacement corresponding to the apertures in the first bar member said apertures adapted for receiving removable pin means to connect the bar members, the second bar member being longitudinally positionable within the side wall portions of the first bar member so that the apertures can be aligned in different configurations.

2. The locking mechanism of claim 1 in which the second bar member is longitudinally slideable within the side wall portions of the first bar member so that the inner apertures of each member can be aligned and a single pin through said apertures will lock the bars, thus permitting the door to be open for the longitudinal distance between the apertures while remaining securely locked.

3. The locking mechanism of claim 1 in which the distal end of the second bar is rounded in a vertical plane in the form of a half circle whose center is coincident with the center of the distal aperture so as to permit free toggling motion.

4. The locking mechanism of claim 1 in which the proximal end of the first bar member contains an insert section immovably fastened between the sidewall portions of the channel, said insert section being pivotally mounted to the anchor means and serving as an extension of the first bar member to permit adaptation of the locking mechanism to doors of various widths.

5. The locking mechanism of claim 1 which further includes user releasable locking pin means.

6. The locking mechanism of claim 1 in which the bar members are positioned with both sets of apertures aligned so that the distal end aperture of one bar member overlies the inner aperture of the other bar member whereby when pins are present through both sets of apertures the bars are in locked configuration, but when only a single pin is present through the inner aperture of the first member and the distal aperture of the second member the bars are pivoted in a toggling relationship to permit the door to be opened.

7. The locking mechanism of claim 1 in which the bar members are positioned with the inner apertures of each member aligned whereby a single pin placed though said inner apertures will lock the bars thus permitting the door to be opened for the longitudinal distance between the apertures while remaining securely locked.

8. The locking mechanism of claim 2 which further includes user releasable locking pin means.

9. The locking mechanism of claim 3 which further includes user releasable locking pin means.

* * * * *